United States Patent [19]

Olsson

[11] Patent Number: 4,534,606

[45] Date of Patent: Aug. 13, 1985

[54] CONNECTOR FOR PRINTED CIRCUIT BOARDS

[75] Inventor: Billy E. Olsson, New Cumberland, Pa.

[73] Assignee: AMP Incorporated, Harrisburg, Pa.

[21] Appl. No.: 626,351

[22] Filed: Jun. 29, 1984

Related U.S. Application Data

[63] Continuation-in-part of Ser. No. 519,449, Aug. 2, 1983, abandoned.

[51] Int. Cl.[3] ..... H01R 9/09

[52] U.S. Cl. ..... 339/75 M; 339/17 M; 339/176 MP

[58] Field of Search ..... 339/75 MP, 75 M, 176 MP, 339/74 R, 17 M, 17 LM

[56] References Cited

U.S. PATENT DOCUMENTS

| | | | |
|---|---|---|---|
| 3,430,182 | 2/1969 | Blanche | 339/17 M |
| 3,636,499 | 1/1972 | Winklebleck | 339/75 MP |
| 4,445,735 | 5/1984 | Bonnefoy | 339/17 M |
| 4,451,818 | 5/1984 | Grabbe et al. | 339/176 MP |
| 4,461,522 | 7/1984 | Bakermans et al. | 339/17 M |
| 4,469,389 | 9/1984 | Grabbe et al. | 339/176 MP |
| 4,477,133 | 10/1984 | Cosmo | 339/176 MP |
| 4,488,766 | 12/1984 | Cosmo | 339/75 MP |

FOREIGN PATENT DOCUMENTS 1410779 10/1975 United Kingdom ..... 339/17 M

OTHER PUBLICATIONS

IBM Technical Disclosure Bulletin, vol. 4, No. 9, 2/1962, "Circuit Board Assembly", Rice et al.

*Primary Examiner*—John McQuade

*Attorney, Agent, or Firm*—F. Brice Faller

[57] ABSTRACT

Daughter board to mother board connector comprises an elongate dielectric housing having perpendicular faces which mount against respective boards over parallel rows of contact pads. Housing has a plurality of parallel planar recesses which open on the faces and receive flat contacts. Contacts have rectangular apertures which align with an axial opening through the housing. An insulated keying shaft having a square profile is contained in the opening and fits closely through the apertures so that rotating the shaft effects rotation of the contacts. Each contact is a plate cam having lobes which wipe across the pads as the shaft rotates causing the cam to translate transversely of the axis of the shaft as parallel walls of the aperture slide across parallel surfaces of the shaft. A spring nested in each recess opposite the faces deflects resiliently to cause contact pressure which is enhanced by an additional lobe facing the spring.

9 Claims, 8 Drawing Figures

CONNECTOR FOR PRINTED CIRCUIT BOARDS

This application is a continuation-in-part of U.S. patent application Ser. No. 519,449, filed Aug. 2, 1983, now abandoned.

BACKGROUND OF THE INVENTION

The present invention relates to an electrical connector for two rows of contacts, particularly for contacts at the interface between a mother board and a daughter board.

Circuit boards are commonly interconnected by providing connectors on a mother board which each receive the edge of a daughter board. The connectors have rows of spring contacts therein which electrically interconnect circuit traces on the daughter board to circuit traces on the mother board. The connectors are commonly designed as zero insertion force or "ZIF" connectors, the daughter board being inserted in a recess having spring contacts on either side thereof. A cam key is then moved to bring contact pressure to bear against the contact pads on the daughter board. This is accomplished by removing a key which deflected the contacts away from the daughter borad, or by rotating a key to reverse the deflection. The connection to the mother board is frequently via pins in plated through holes, which usually require soldering after insertion of pins.

Surface mount capability is becoming increasingly desirable from a manufacturing standpoint, insofar as pins are eliminated. Thus, a connector having contacts which can wipe against contact pads on both boards is needed; wiping is desirable as it removes surface impurities to improve electrical contact. The trend of increasing miniaturization makes a high contact density also desirable.

U.S. Pat. No. 3,715,706 discloses an electrical connector for interconnecting first and second substantially parallel rows of uniformly spaced surface contacts on respective first and second surfaces at substantially right angles to each other. The connector comprises an elongate dielectric housing having a first face for mounting against the first surface over said first row of surface contacts and a second face for mounting against the second surface over the second row of surface contacts, the second face being substantially perpendicular to the first face. The housing has a plurality of parallel planar recesses therein, each recess extending into the first face and the second face and continuously therebetween, the recesses being spaced as the surface contacts and defining parallel planar barriers therebetween. The connector further comprises a plurality of contacts in respective recesses, each contact having first and second contact surfaces on the periphery thereof at respective first and second faces of the housing.

The described connector utilizes contacts formed from a single long piece of spring metal to form contact surfaces integral with a spring. The connector is not a "ZIF" connector insofar as contact surfaces are urged toward respective housing faces at all times, and contact forces are limited. Further, the current path between the surfaces, which are usually on circuit boards, is much longer than the direct distance between surfaces.

SUMMARY OF THE PRESENT INVENTION

According to the invention, an electrical connector as defined above is characterized in that the housing has an axial opening therethrough which intersects the barriers perpendicular thereto, spring means disposed in each recess opposite the intersection of the first and second faces, and a keying shaft passing coaxially through the opening. The shaft is profiled to rotate in the opening and has opposed parallel planar keying surfaces. Each contact is in the form of a plate cam disposed in a respective recess and has an aperture therethrough, the shaft passing through each aperture. Each aperture has parallel keying walls which parallel the central axis of the cam on opposite sides thereof and accommodate the keying surfaces of the shaft, the apertures being sufficiently elongate to permit translation of the keying walls relative to the keying surfaces. Each cam has a bearing surface on the periphery thereof intersected by said central axis opposite said first and second contact surfaces. Each cam has lobe means on the periphery thereof, the lobe means being situated to bring the spring means to bear against the bearing surface as the keying shaft is rotated in the housing from a disengaged to an engaged position.

The connector of the present invention is designed for mounting at the interface between the edge of a daughter board and a mother board, and provides a direct current path between contact pads on the respective boards. The connector can be used as a single unit attached to one side of the daugher board as well as in pairs mounted to the mother board on both sides of the daughter board; in this configuration the daughter board would be inserted between the connectors. The contacts do not engage the pads with contact pressure until a keying shaft through the contacts is rotated. Each contact has lobes which bear against the pads with increasing pressure as the shaft is rotated. The shaft has a square cross section and passes closely through a rectangular aperture in each cam. Rather than displacing the boards, the lobes cause the cams to translate transversely to the axis of rotation, as parallel walls of the apertures slide on parallel surfaces of the keying shaft. This deflects a piece of spring steel nested in the recess opposite the boards, and brings pressure to bear at the boards. An additional cam lobe in direct contact with the spring serves to increase the pressure. The spring serves no electrical function.

As the cam is rotated, the lobes wipe across the contact pads on the circuit boards. This assures good electrical contact. The plate cam provides a direct current path which is significantly shorter than with the spring contacts of the prior art.

A major advantage of the connector is simplicity of manufacture. The cams, which serve as the contacts, can be stamped from strip stock and partially immersed in plating baths while in strip form to obtain gold plating on the contact lobes. The flat design of the contacts and spring simplifies assembly. The parts are simply dropped into the planar recesses in the connector housing followed by insertion of the keying shaft therethrough. The keying shaft can be steel with a baked enamel surface to electrically isolate the cams, or the apertures in the cams can be individually insulated.

Another major advantage is that the flat contact design permits a high density spacing.

DETAILED DESCRIPTION OF THE PREFERRED EMBODIMENT

Figures 1, 4A, 4B, 4C:
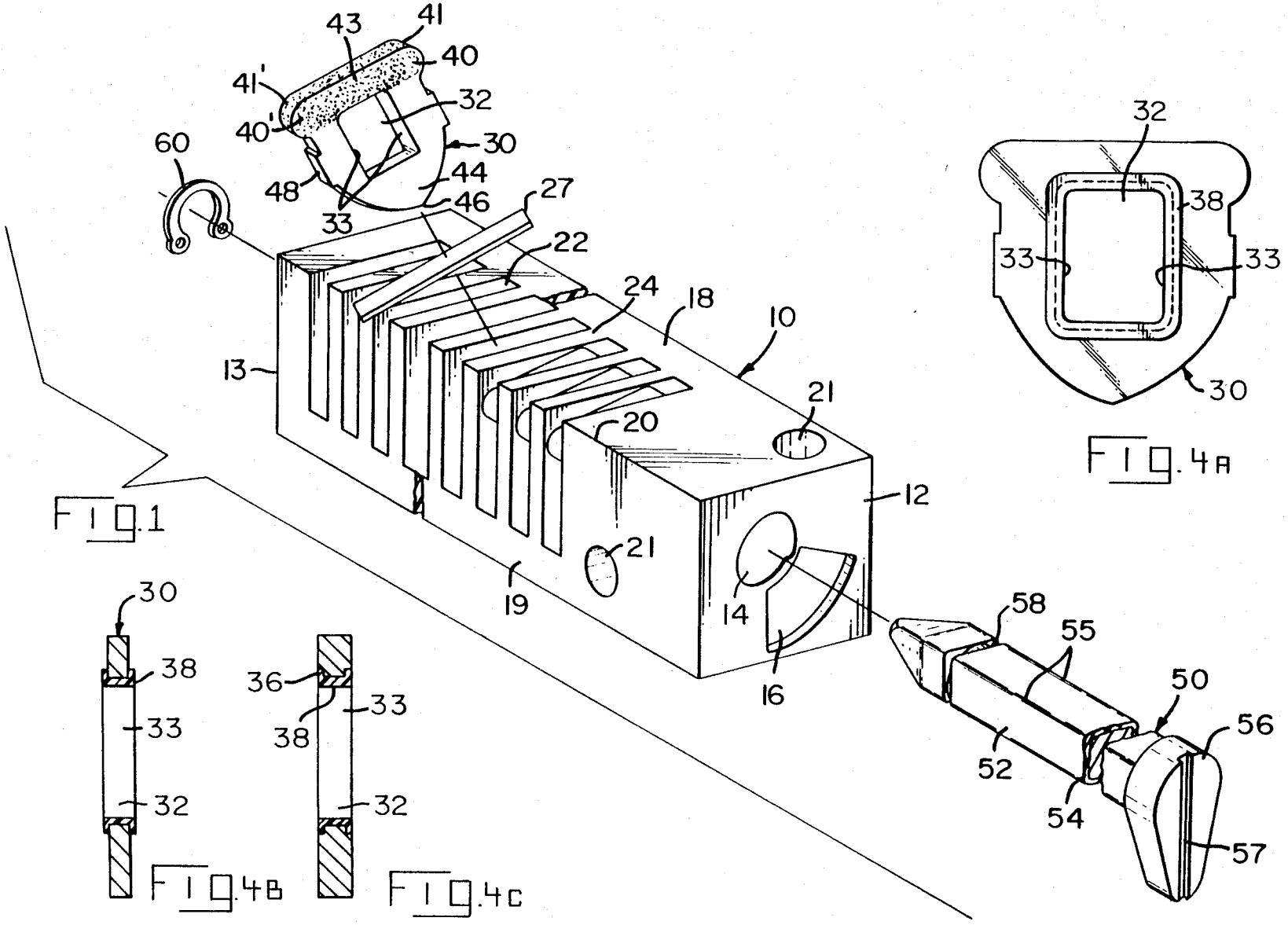
FIG. 1 is an exploded perspective of the connector.
FIG. 4A is a plan view of a cam with a molded insert.
FIGS. 4B and 4C are section views of the cam with molded insert.

FIG. 1 illustrates the components of the connector exploded apart; they will be described in order of assembly. An elongate dielectric housing 10 of square cross section has a first end 12, an opposed second end 13, and an axial opening 14 extending between the ends. First end 12 has a depression 16 for locking the keying shaft 50 as will be described. First planar face 18 and second planar face 19 are perpendicular, meeting at corner 20. A series of parallel planar recesses 22 of like profile extend into faces 18, 19; each recess 22 is continuous between faces 18, 19, the plane of each recess 22 being perpendicular to the planes of the faces 18, 19. The recesses 22 define parallel planar barriers 24 therebetween which are intersected by opening 14 as will appear more clearly in FIGS. 3A to 3C. Retention holes 21 extending through the housing 10 serve to hold same against mated circuit boards (FIG. 2).

Referring still to FIG. 1, a spring 27 is inserted in each recess 22 and nests in the bottom thereof. The spring 27 is stamped from flat hard spring steel, or may alternatively be a piece of music wire. After the springs 27 are installed, a contact in the form of plate cam 30 is dropped in each recess 22 on top of the spring 27, oriented as shown. The plate cam 30 is stamped from sheet metal with a rectangular aperture 32 having parallel keying walls 33. The keying walls 33 define the central or sliding axis of the cam parallel thereto and midway therebetween. Each cam 30 has two contact lobes 40, 40' symmetrically spaced from the central axis, the lobes 40, 40' having respective contact surfaces 41, 41' which are flush with respective first and second faces 18, 19 of housing 10 when the cams 30 are installed in recesses 22 as shown. The periphery of cam 30 is further profiled by a bearing lobe 44 with a bearing surface 45 and a toe or apex 46 on the central axis. The lateral tabs 48 remain after the cams 30 are sheared from strip stock.

After the springs 27 and cams 30 are installed in the housing 10, the keying shaft is installed by inserting into opening 14 from first end 12 until a ring clip 60 can be snapped into lock slot 58 against second end 13. The keying shaft 50 is of generally square profile flanked by parallel keying surfaces 52 which fit between keying walls 33. The shaft 50 has rounded corners for journaling in opening 14 and a dielectric surface 54 such as enamel which may be electrostatically sprayed on and baked to harden. End 56 of shaft 50 is in the form of a handle having a screw driver slot 57.

Figure 2:
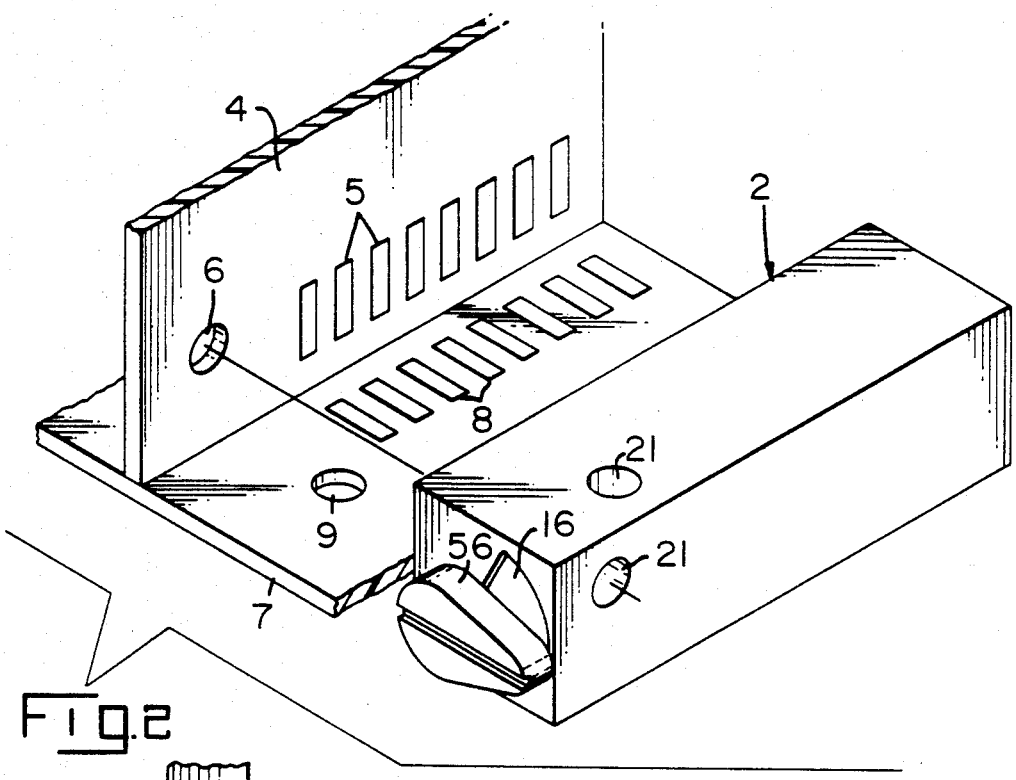
FIG. 2 is a perspective of the assembled connector exploded from the circuit boards.

FIG. 2 illustrates the assembled connector 2 before assembly to daughter board 4 and mother board 7. The connector 2 is first fastened to daughter board 4 with first face 18 against surface contacts 5. The connector 2 and daughter board 4 are then fixed to mother board 7 with second face 19 against surface contacts 8. Fastening may be by screws through holes 21 in the housing and holes 6, 9 in boards 4, 7 respectively, or by latches or other means well known in the art. Alternatively, two such connectors are fixed to the mother board and receive a daughter board therebetween in the manner of a card edge connector. The principles of operation of the connector are the same in either case.

Figure 3A:
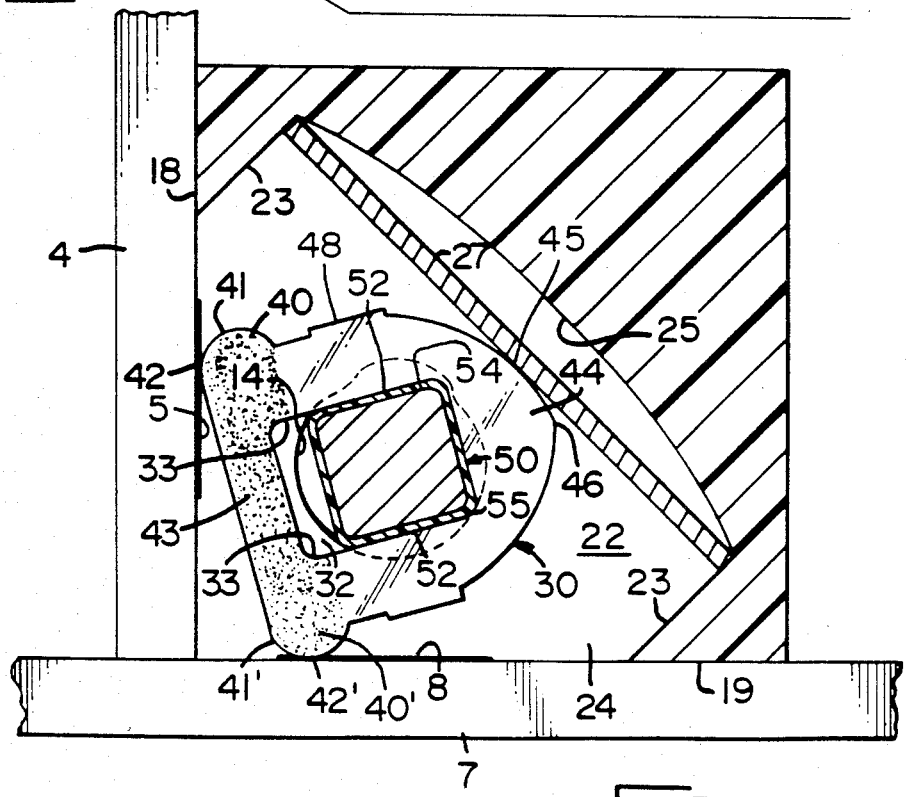
FIG. 3A is a section view illustrating the connector in the disengaged position.

FIG. 3A is a cross section illustrating the connector 2, as assembled to daughter board 4 and mother board 7, in the disengaged position. The spring 27 is nested in recess 22 between sidewalls 23 adjacent bottom 25. The contact surfaces 41, 41' on lobes 40, 40' touch surface contacts 5, 8 at contact points 42, 42'. The center axis of cam 30 is about thirty degrees from perpendicular to spring 27 and the apex 46 of bearing lobe 44 is likewise offset, so that the spring 27 is unflexed. No pressure is exerted at contact points 42, 42' while spring 27 is unflexed before torque is applied to shaft 50. It is important that the upper contact point 42 remain inside first surface 18 whether or not board 4 is in place; this will prevent interference during insertion of a daughter board 4 when two connectors 2 are used in opposite sides of the board. Note that opening 14 is generally in the shape of a circular bore albeit with a relief 15 in the circumference thereof; without relief 15, i.e., if the opening 14 were simply a circular bore, counterclockwise motion of shaft 50 from the position shown would not be possible as it would be bound in the position of FIG. 3A. Other profiles of opening 14 which would likewise contain the shaft 50 sufficiently loosely to permit transverse shifting thereof during rotation are possible. In addition to the relief 15, there must be slight looseness between other corners 55 and the circumference of opening 14.

Figure 3B:
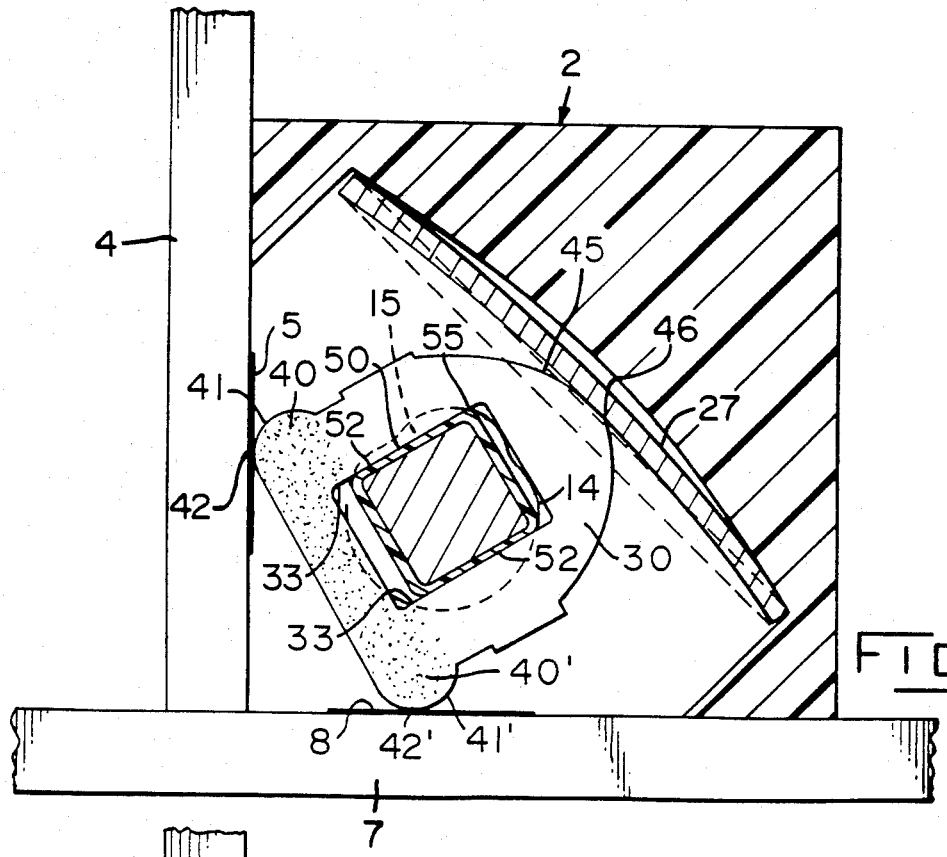
FIG. 3B is a section view illustrating the connector in the partially engaged position.
Figure 3C:
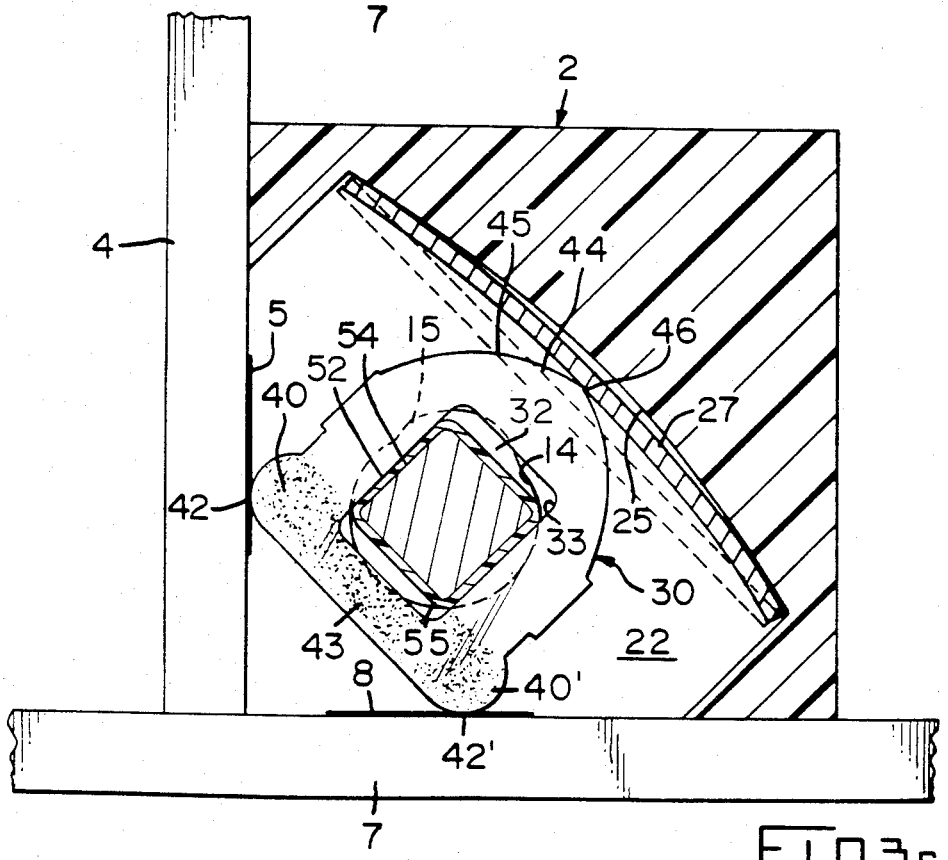
FIG. 3C is a section view illustrating the connector in the fully engaged position.

FIG. 3B is a cross-section of the connector 2 after the shaft 50 has been rotated counterclockwise through approximately fifteen degrees to a point midway between the disengaged position (FIG. 3A) and the fully engaged position (FIG. 3C). As the shaft 50 is rotated, it migrates upward so that a corner 55 enters the relief 15. This shifts the axis of rotation of both the shaft 50 and cam 30 to lessen the binding forces and permit rotation. During rotation, the cam 30 also translates parallel to the central axis of the cam as keying walls 33 slide along keying surfaces 52 on shaft 50, which is covered by insulation 54. During rotation, the contact points 42, 42' shift in perpendicular directions as contact surfaces 41, 41' wipe across respective surface contacts 5, 8.

FIG. 3C is a cross-section of the connector 2 in the fully engaged position, with the central axis of cam 30 at about forty-five degrees to both boards 4 and 7. Here the system is in equilibrium; the apex 46 of bearing surface 45 is against spring 27 and contact points 42, 42' are each subject to equal contact pressure. Referring back briefly to FIG. 1, a stud (not shown) on handle 56 opposite slot 57 cooperates with depression 16 in end 12 of housing 10 to limit rotation of shaft 50. Rotation is limited when the shaft 50 is rotated counterclockwise a few degrees beyond the position of FIG. 3C, which serves as a locking feature due to the turning force needed to overcome the imbalance presented when the central axis of cam 30 is other than forty-five degrees to boards 4 and 7.

An important feature of the invention is that rotation of the cam 30 causes contact surfaces 41, 41' to wipe across respective surface contacts 5, 8 on boards 4, 7. This removes oxides and other impurities at the contact points 42, 42' to assure good electrical connection, which is further enhanced by gold plating 43 denoted by stippling. Note that contact points 42, 42' migrate on both the respective surface contacts 5, 8 and on the contact surfaces 41, 41' of respective contact lobes 40, 40'. The amount of wipe on contact surface 41, 41' depends on the radius of curvature of lobes 40, 40', the wipe increasing with the radius. Some clearance between keying surfaces 52 of shaft 50 and the keying walls 33 of aperture 30 is desirable to assure equal distribution of contact pressure at each point 42, 42'. The electrical path between contact points 42, 42', insofar as it is direct, is as short as possible. This is unlike prior art elements where the electrical contact is in the form of a spring. Applicant's invention employs a conductive cam which undergoes both rotation and translation in response to rotation of a keying shaft. The spring 27 has no electrical function; it simply provides contact pressure to the printed circuit board pads 5, 8.

FIGS. 4A, 4B, and 4C illustrate an alternate scheme for electrically isolating the cams 30. Rather than insulating the keying shaft, a dielectric grommet 38 molded of nylon or the like is provided in aperture 32. This may be fitted to a cam 30 as shown in the cross section of FIG. 4B, or alternatively aperture 32 may be provided with a stepped edge 36 by coining during stamping.

The invention contemplates a plate cam 30 with lobes which may have a variety of configurations. Note that bearing lobe 44 merely causes additional flexure of spring 27 which in turn causes additional contact pressure at points 42, 42'. Absent lobe 44, translation of the cam 30 along its central axis and wiping would still occur. The amount of wipe and contact pressure are determined by factors such as the spacing of contact lobes 40, their radius of curvature, lift, and configuration of spring 27. On the other hand, eliminating contact lobes 40, 40' and providing a round cam heel would result in a more conventional plate cam which would not translate along the central axis, although the bearing lobe 44 would cause contact pressure as the cam plate would tend to move along the central axis. Further, contact points 42, 42' would not migrate on surface contacts 5, 8.

The foregoing description is exemplary and not intended to limit the scope of the claims which follow.

I claim:

1. Connector for interconnecting first and second substantially parallel rows of uniformly spaced surface contacts on respective first and second surfaces at substantially right angles to each other comprises:

an elongate dielectric housing having a first face for mounting against said first surface over said first row of surface contacts and a second face for mounting against said second surface over said second row of surface contacts, said second face being substantially perpendicular to said first face, said housing having a plurality of parallel planar recesses therein, each said recess extending into said first face and said second face and continuously therebetween, said recesses being spaced as said surface contacts and defining parallel planar barriers therebetween, said housing having an axial opening therethrough which intersects said barriers perpendicular thereto, spring means disposed in each said recess opposite the intersection of said first and second faces, a keying shaft passing coaxially through said opening, said shaft being profiled to rotate in said opening, said shaft having parallel planar keying surfaces, a plurality of plate cams disposed in respective recesses, each said cam having an aperture therethrough, said shaft passing through each said aperture, said aperture having parallel keying walls which parallel the central axis of the cam on opposite sides thereof and accommodate said keying surfaces of said shaft, said apertures being sufficiently elongate to permit linear translation of said keying walls parallel to said keying surfaces, each said cam having first and second contact surfaces on the periphery thereof on opposite sides of said central axis at respective first and second faces of said housing and a bearing surface on the periphery thereof intersected by said central axis opposite said first and second contact surfaces, each said plate cam having lobe means on the periphery thereof, said lobe means being situated to bring said spring means to bear against said bearing surface as said keying shaft is rotated in said housing from a disengaged to an engaged position, whereby, upon rotating said shaft from said disengaged to said engaged position when said first and second faces have said first and second surfaces thereagainst said cams will translate parallel to said keying surfaces and said contact surfaces will be urged against said surface contacts on said surfaces at respective first and second contact points.

2. The connector of claim 1 wherein said lobe means comprises a pair of contact lobes at said first and second faces symmetrically spaced from said central axis, said contact surfaces lying on said lobes, said central axis approaching an orientation of forty-five degrees to each face as said shaft is rotated to said engaged position, whereby, upon rotating said shaft from said disengaged to said engaged position when said first and second faces have said first and second surfaces thereagainst, said contact surfaces will wipe across respective surface contacts as said contact points translate relative thereto and said cams will translate along said central axis so that said spring means brings resilient pressure to bear at said contact points and contact pressure is increased thereat.

3. The connector of claim 1 wherein latching means is provided between said keying shaft and said housing, said latching means being effective to hold the cams such that the central axis thereof is slightly offset from forty-five degrees to each said surface when the shaft is in the engaged position.

4. The connector of claim 2 wherein the angle between first and second lines taken through respective first and second contact points and the center of the shaft is from ninety to one hundred degrees when the connector is assembled to the surfaces and the shaft is in the disengaged position, said angle becoming more oblique as said shaft is rotated toward the engaged position due to the linear translation of the cams relative to the axis of rotation.

5. The connector of claim 1 wherein said spring means comprises individual springs in respective recesses.

6. The connector of claim 1 wherein said plate cams are stamped from sheet metal, the surface of said shaft in contact with said cams being insulated therefrom, whereby said cams are insulated from each other.

7. The connector of claim 6 wherein said shaft is metal with a dielectric coating thereon.

8. The connector of claim 1 wherein said lobe means comprises a bearing lobe intersected by said central axis and adjacent said spring means opposite said first and second contact surfaces, said bearing surface lying on said bearing lobe, whereby, upon rotating said shaft from said disengaged to said engaged position when said first and second faces have said first and second surfaces thereagainst, said contact surfaces will wipe against respective surface contacts as said spring means brings increasing resilient pressure to bear on said bearing surface and said cams are urged toward said surfaces to increase contact pressure thereat.

9. The connector of claim 1 wherein said axial opening is generally profiled as a circular bore, said bore having a relief in the circumference thereof which permits shifting of the keying shaft transversely of its axis.

* * * * *